United States Patent [19]

Finck, Jr.

[11] Patent Number: 4,474,041

[45] Date of Patent: Oct. 2, 1984

[54] LOCK HOUSING AND LOCK ASSEMBLY UNIT

[75] Inventor: Frederick P. Finck, Jr., Fairfield, Conn.

[73] Assignee: Highfield Mfg. Company, Bridgeport, Conn.

[21] Appl. No.: 415,623

[22] Filed: Sep. 7, 1982

[51] Int. Cl.[3] ..... B65D 55/14

[52] U.S. Cl. ..... 70/159; 70/34

[58] Field of Search ..... 70/32, 33, 34, 23, 158–162

[56] References Cited

U.S. PATENT DOCUMENTS

| | | | |
|---|---|---|---|
| 1,790,656 | 2/1931 | Ganz . | |
| 2,166,660 | 7/1939 | Handshy et al. . | |
| 2,319,753 | 5/1943 | Smith | 70/34 |
| 2,458,046 | 1/1949 | Audet . | |
| 3,157,040 | 11/1964 | Raye . | |
| 3,785,670 | 1/1974 | Smith | 70/34 |
| 3,973,420 | 8/1976 | Brady et al. . | |
| 4,040,279 | 8/1977 | Signorelli et al. . | |
| 4,075,877 | 2/1978 | Van Gompel | 70/34 |
| 4,096,718 | 6/1978 | Michelman et al. . | |
| 4,114,409 | 9/1978 | Scire . | |
| 4,120,182 | 10/1978 | Michelman et al. . | |
| 4,120,183 | 10/1978 | Walters . | |
| 4,144,729 | 3/1979 | Nielsen, Jr. . | |
| 4,155,232 | 5/1979 | Haus, Jr. et al. . | |
| 4,254,647 | 3/1981 | Finck, Jr. . | |
| 4,313,319 | 2/1982 | Haus, Jr. et al. . | |

FOREIGN PATENT DOCUMENTS

| | | | |
|---|---|---|---|
| 372879 | 4/1923 | Fed. Rep. of Germany | 70/34 |
| 1380239 | 1/1975 | United Kingdom . | |

*Primary Examiner*—Robert L. Wolfe

*Attorney, Agent, or Firm*—Nolte, Nolte and Hunter

[57] ABSTRACT

A lock housing and lock assembly unit for use with electric and gas fuel meter enclosures and the like is disclosed, including a lock plunger for mating with a locking stud and biasing means for urging the plunger into the lock position. The plunger and biasing means are captured within the lock housing by a cap which is press fit or otherwise permanently installed in the housing or made of part thereof. Temporary detent means may be provided to position the plunger in the open position prior to installation. A key is inserted through a key hole in the cap and in a socket in the plunger to withdraw the plunger to the open position within the housing. The invention lends itself to various plunger-stud mating designs and is adaptable to lock-key surface mating for selective key operation.

9 Claims, 8 Drawing Figures

LOCK HOUSING AND LOCK ASSEMBLY UNIT

FIELD OF INVENTION

The present invention relates to locks for use in security systems typified by those used by utility companies and in which a large number of electric power and gas fuel metering stations are secured against unauthorized access and permit the installation of the locks and access to the metering stations by security cleared personnel only.

HISTORY OF INVENTION

It is a present practice when installing locks for utility meters of the type disclosed in U.S. Pat. Nos. 4,254,647 and 4,415,190 to have field men, who may not have security clearance, install the stud and barrel lock housing elements and then to have security cleared personnel insert the barrel lock which mates with the stud and is retained in place by the extended positioning of expansible balls, for example, which are operated via a key retained by the security cleared installer. The barrel lock is then removable only by security cleared personnel having barrel lock keys.

In situations where there is but one security cleared installer, two installation operations still must be performed and the installer must carry with him the necessary number of barrel locks and keys for each installation.

The particular type of barrel lock presently in use is the standard utility lock typified by the disclosures in U.S. Pat. Nos. 4,144,729 and 4,120,182. These locks have become widely accepted in the utilities industry, because of the security which they afford due to the strength of the barrel/stud construction and of the inaccessibility of these parts of tampering, particularly where fully enclosed and protected as disclosed in U.S. Pat. No. 4,254,649 and in the aforementioned pending application.

The present invention contemplates an even stronger lock construction and the elimination of the security requirement of the two installation operations; i.e., installation of the stud and lock housing and then of the barrel lock, the first installation frequently being performed by one field operator and the second installation operation by a second and security cleared field operator.

As is known, in the standard barrel lock of the prior art, the expansible balls are retained in their extended, locking position by a plunger. A strong; that is, a relatively high compression spring element is required for retaining the plunger in the closed position in which the balls extend outwardly of the lock barrel shaft for retention against a groove in the stud or in the lock housing. This is an expensive construction because of the number of parts to be machined, bored and fitted. Furthermore, because the lock barrel shaft itself must be bored to incorporate the plunger and spring elements, its shear strength is thereby diminished.

THE INVENTION

The present invention provides a solid lock plunger for stud mating and is incorporated and captured within the lock housing. Biasing means are provided for retaining the plunger in the lock position after installation, but means are provided to position the plunger in the open position against the force of the biasing means prior to installation and which is then removable by the installer.

The lock of the invention is operable to withdraw the plunger from its mating relationship with the stud against the force of the biasing means by means of a key which interacts with an upper portion of the plunger. The construction is such that the entire lock assembly is retained within the barrel housing whether in the open or locked position.

In all preferred embodiments of the invention, a lock housing and lock assembly are provided as a unit, the lock housing part of which may be, as disclosed in U.S. Pat. No. 4,254,647, secured to or integral with a flange which is to overlay the cover of a closure or as disclosed in U.S. Pat. No. 4,415,190 secured to an end of a lock ring assembly for electric meters. In all events, the housing of the locking unit of the present invention provides a stud opening to receive the locking stud member which is normally disposed upon the closure to be locked or on the other end of the ring in the locking ring assembly. The invention, of course, may be utilized in any environment where security arrangements may require the special locking and unlocking procedures discussed.

The locking plunger of the lock assembly is designed to mate with stud members formed as in prior art applications; i.e., with a cut-out portion or opening to receive the plunger. As in constructions of the prior art, the stud member extends and may be movable generally along one axis while the locking member extends and is movable along an axis perpendicular to the stud axis.

The lock housing is preferably fabricated of metal stock having intersecting bores, one comprising a lock receiving opening for retention of the locking member and the other comprising the stud opening for reception of the stud.

In a simple form of the invention, the locking assembly comprises a cap, press fit or otherwise retained in one end of the lock housing, a locking plunger slidable within the lock receiving opening or bore below the cap and to and from a position intersecting the stud receiving opening or bore. A compression spring is interposed between the cap and plunger urging the plunger into the closed or locked position. The cap and plunger are provided with aligned key bores providing access from the outside of a key through the cap to the plunger, whereby the plunger may be lifted to the open position against the pressure of the spring.

The housing may be provided with a small opening in the housing body to receive the shaft of a detent pin just above the stud receiving opening. The detent is inserted through the housing wall across the lock opening below the plunger in the raised or open position to retain the plunger above the stud receiving opening prior to installation of the housing and lock assembly unit. Thus, when the stud and housing and lock assembly are in place, the detent pin may be removed to allow the plunger to snap into the lock position under the urging of the compression spring against the cap.

In a particular embodiment of the invention, the spring urging the plunger into the lock position is protected from grabbing by the key by a wall which may be formed integrally with the plunger.

Because the present invention provides a unitary plunger, the mating of the plunger and locking stud lends itself to uncomplicated designs and in one embodiment of the invention, the stud, instead of being formed with an opening to accommodate the plunger, is formed with an annular groove about the top of which the plunger, shapped as a saddle, may reside in the locked position between the walls of the annular groove, thereby preventing relative axial movement of the stud.

The assembly provided for installation may also include the locking stud member in place in the stud receiving opening of the housing and in mating relationship with the plunger in the lock position so that the stud may not be removed from the housing without withdrawing the plunger to the open position with the security key. In such a case, the stud is provided at its outer end with means, such as a flange, for securing it to the enclosure to be locked and in which a threaded opening, for example, is provided to receive a bolt for attaching the stud and thus the lock housing and lock assembly to the enclosure. The entire assembly would, therefore, include the bolt, flanged stud, lock housing and lock assembly and where desirable, a back-up bar between the bolt head and flange for installation against the wall of the enclosure.

Inasmuch as the lock assembly of the invention is not removable from the lock housing as in prior art devices, the invention contemplates the provision of a tamper-detecting wired seal for overlying the key bore of the cap and which must be broken or removed before a key can be inserted and, therefore, providing immediate detection of unauthorized or attempted unauthorized lock tampering.

As will be appreciated, the present invention also lends itself to modification for permitting the use of various lock barrel-type keys and, in this respect, the outer surface of the cap of the lock assembly may be shaped to mate only with portions of a specific key so as to permit the plunger portion of that key only to enter the key bore of the lock assembly plunger. This type of key and lock interfacing is disclosed in U.S. Pat. No. 4,313,319.

The invention will be more fully understood by referring to the following specification taken in conjunction with the drawings.

Figure 1:
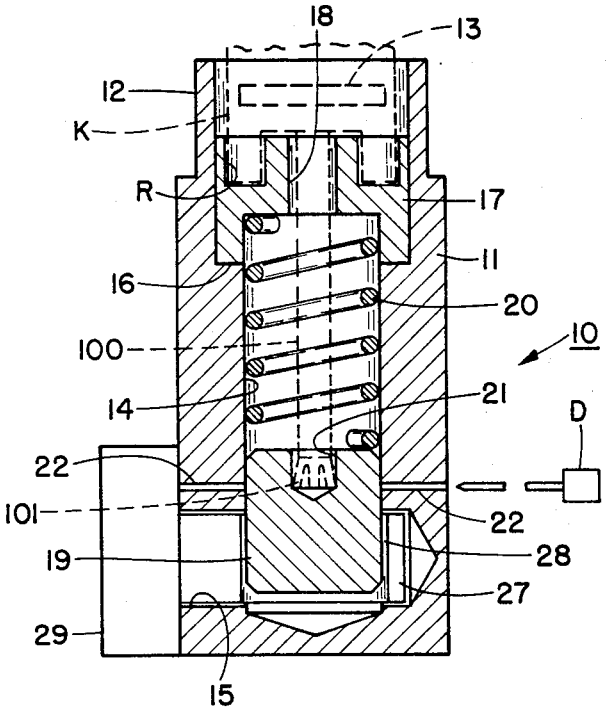
FIG. 1 is a vertical cross section of the unitary housing and lock assembly of the invention.
Figure 2:
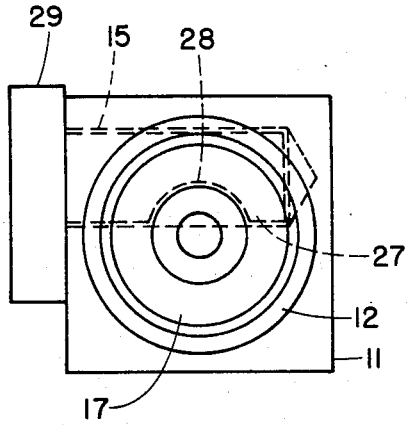
FIG. 2 is a top plan view of the assembly of FIG. 1.

In FIGS. 1 and 2, the lock housing and lock assembly 10 is shown to comprise the lock housing 11 formed from a square cross section steel rod with its upper end machined to form a cylindrical collar at its top portion 12 which may be conveniently provided with slots 13 (shown in phantom in FIG. 1) which may be used as seal ferrules for receiving a seal which would have to be broken or removed before a key may be inserted into the lock. Inasmuch as the lock assembly is not removed as in prior art devices, the seal not shown in FIGS. 1 and 2, should provide a key entry blocking portion between the ferrules within the collar, as disclosed in the embodiment of FIG. 4, to be discussed.

The housing of FIG. 1 is shown formed with a lock bore 14 extending from its open end at the upper portion of the housing to its closed end where it is intersected by a locking stud bore 15 extending from its open end in the side of the housing to its closed end on the other side of the lock bore.

The lock bore is stepped so that the upper end of the lock bore, just below the top portion, is wider than the lower portion of the bore and provides a shoulder 16 for seating the lock cap 17 which is dimensioned to be press fit into the wider upper portion of the lock bore so that it may not be removed once in place. The cap 17 is formed with a central bore providing key entry hole 18. It is understood that the mode of capturing the cap so that it may not be unseated may take any form; e.g., the cap may be welded in place.

Captured beneath the lock cap 17 are the two operating elements of the lock; i.e., the lock plunger 19, shown in FIG. 1 urged into the lock position by lock spring 20.

The lock plunger 19 is made of solid, cylindrical steel stock and is provided with a key receiving socket 21 at its upper end, aligned with key entry hole 18 in the cap 17.

A small bore 22 extends radially to the axis of the lock bore 14, through the lock housing 11 on either side of the lock bore just above the locking stud bore and into which a detent D may be fitted to extend through the lock bore to underlie the lock plunger and to retain the same in the unlocked or open position to which it is drawn upwardly against the urging of the lock spring 20. Thus, the lock housing the lock assembly may be delivered for installation without the necessity of the installer to carry the key to the lock. Once the installation is made and the locking stud member is in place, the detent may be removed to permit the lock plunger to be urged into the lock position in mating relationship with the stud.

The locking stud bore 15, while intersecting the lock bore 14, is offset from the axis of the lock bore 14, as best seen in FIG. 2, and is designed for use with a locking stud member 27, having a cutout portion 28 for partially surrounding the lock plunger 19 to prevent axially movement of the stud in its bore. A flange 29 provides means for attaching the stud to the enclosure to be locked and for limiting the axial movement in the stud opening 15 for alignment of the lock plunger 19 and plunger receiving opening or cutout portion 28 in the locking stud member 27.

The upper surface of the cap 17 is ridged, as at R, to form a key body receptical particularly adapted to receive the oppositely formed surfaces of the key body K so that the end of the shaft of the key will reach the key socket 21, as is fully disclosed in U.S. Pat. No. 4,301,319.

Figure 3:
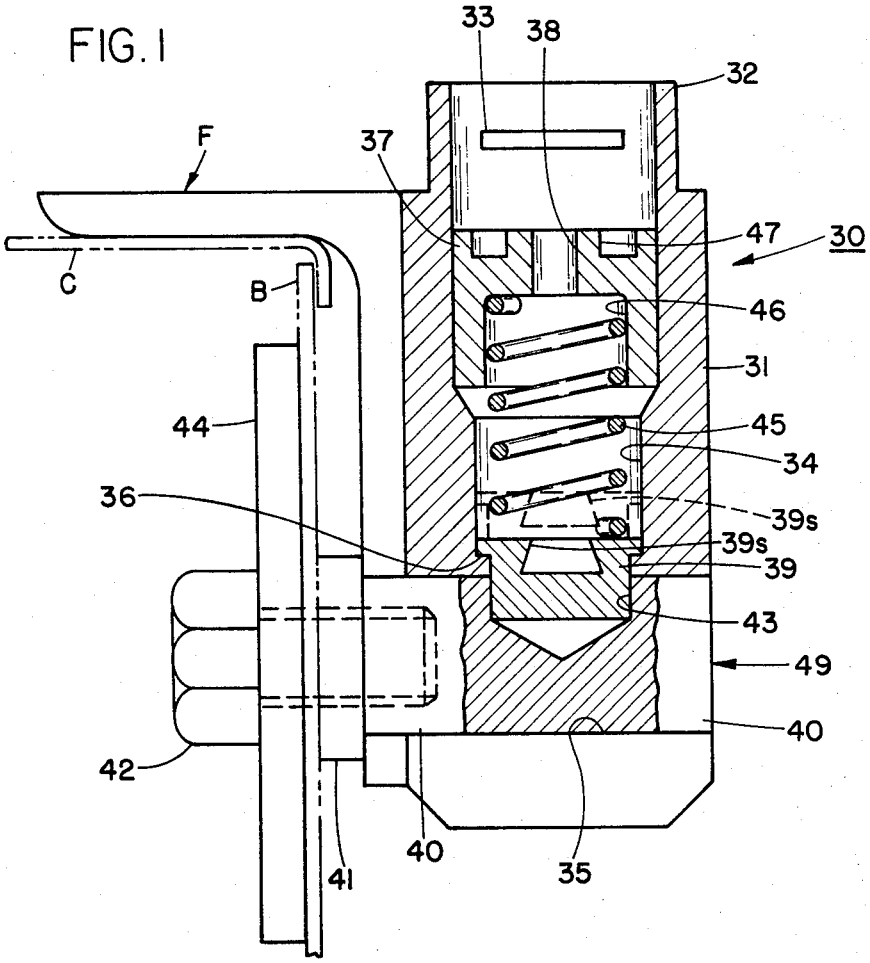
FIG. 3 is a vertical section of a modified housing and lock assembly of the invention secured to a flanged member and shown installed on an electric meter box.
Figure 4:
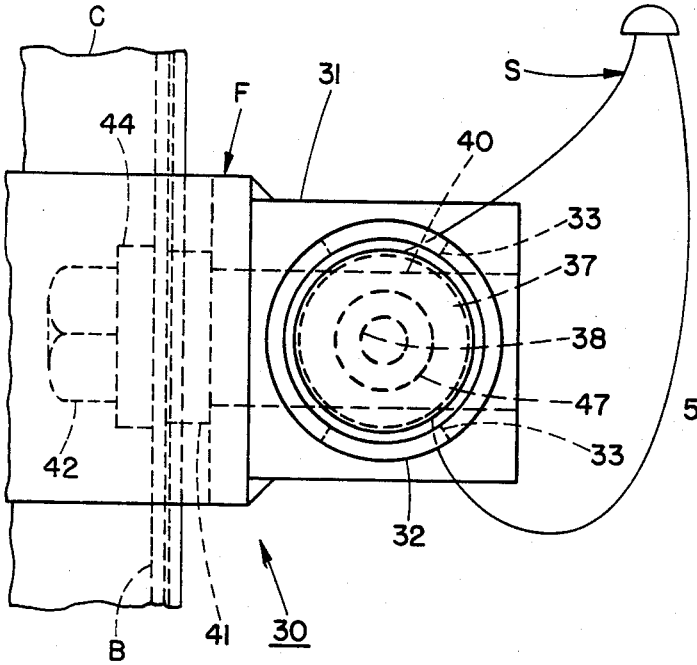
FIG. 4 is a top plan view of the assembly of FIG. 3.

In FIGS. 3–4, the lock housing and lock assembly 30 of the invention is shown incorporated in a force resistant locking device of the type disclosed in U.S. Pat. No. 4,254,647 and in which the lock housing 31 of the present invention is welded to a flanged member F the flange of which overlies the cover C of an enclosure such as a utility metering box B and which is held in the closed position by the interaction of the lock assembly and locking stud 49. In the embodiment of FIGS. 3 and 4, the shaft 40; i.e., the locking portion of the stud 49 is cylindrical and extends from the stud flange 41 with which it is integral. The shaft 40 is formed with a lock plunger receiving opening 43, in this instance at its upper surface, in alignment with the axis of the lock bore 34.

The flange and, thus, the stud is held fast against the wall of the the utility box by means of a threaded bolt 42 extending through a back-up bar 44 on the inside of the utility box and into the mating threaded hole in the flange 41 and shaft 40 of the locking stud. As can be appreciated, the lock assembly and lock housing, welded to the flanged element 30, together with the bolt, back-up bar and flanged stud may be sold as an assembled unit for installation in the field.

As in the embodiment of the invention shown in FIGS. 1 and 2, the housing 31 is formed with a collar 32 at its upper or open end and which is provided with seal ferrules 33. The lock bore 34 extends from its open end at the upper portion of the housing to its closed end where it is intersected by the locking stud bore 35 which extends from one side of the housing to the other. In this embodiment, the shaft 40 of the stud is coterminous at its outer end with the outer surface of the wall of the housing 31 when in the locked position with the plunger 39 urged into the plunger receiving opening 43.

The lock bore 34 is configured to provide a seat 36 for the flange of the plunger 39 and against which the plunger is held fast in the closed position by the urging of the spring 45. The spring and thus the plunger are captured beneath the lock cap 37 which, as in the instance of the FIGS. 1–2 construction, provides an upper spring housing portion 46 formed by a downwardly extending annular portion of the cap 37, for ease in assembly of the cap and spring.

The cap 37 is again press fit into an upper, wider portion of the lock bore or otherwise mated with the housing so that it cannot be removed. The cap provides the key entry opening 38 aligned with the key receiving socket 39s of the plunger 39. The upper surface of the cap is ridged as at 47 for the reception of similiarly, but oppositely ridged surfaces of a key face surrounding the shaft of the key, as more fully disclosed in the aforementioned U.S. Pat. No. 4,301,319.

A seal S, shown only in FIG. 4, provides a key hole cover between the ferrules 33 and the seal wires are sealed at their ends in the usual manner. Thus, entry of a key cannot be made without breaking either the cover or removing the outer wire seal so the wires can be slipped through the ferrules upon lifting of the cover.

Figure 5:
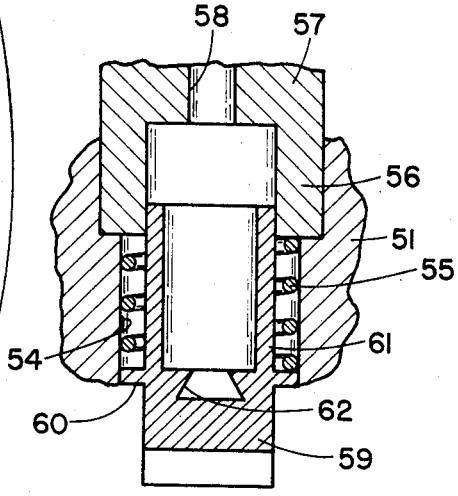
FIG. 5 is a vertical cross sectional view of another modified housing and lock assembly of the invention.

In FIG. 5, another modified version of the invention is shown in which the housing 51 provides the usual lock bore 54 in which the cap 57 is press fit in an upper, wider portion of the bore. The cap provides an annular skirt 56, the outer radial portion of the inner, annular surface of which is seated on the shoulder provided in the bore. The inner radial portion of the annular surface of the skirt acts as the upper seat of the spring 55. As in the construction of FIGS. 3–4, the lower surface of the flange 60 at the upper end of the plunger 59 is seated on a shoulder (not shown) in the lock bore when the plunger is in the locked position. The upper surface of the flange provides a seat for the lower end of the spring 55. The plunger 59 also provides an inner annular sleeve 61 which extends from the plunger into the area surrounded by the skirt 56 of the cap in which the sleeve may move axially. The sleeve 61 provides an inner wall for the spring and protects the spring from snagging with the key shaft which normally provides spreading spring fingers at the end of the key shaft for entry into and gripping relation with the key receiving socket 62. The usual key opening 58 aligned with the socket 62 is provided in the cap.

Figure 6:
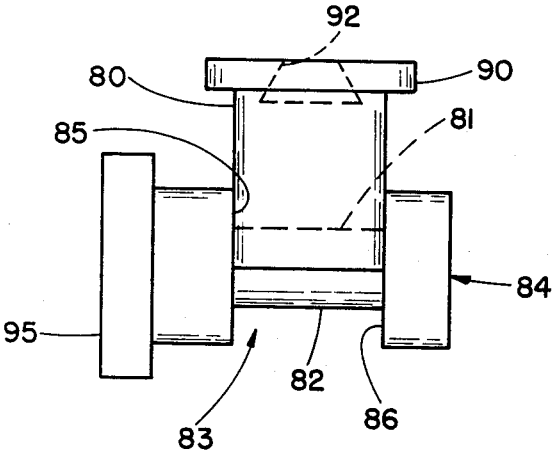
FIG. 6 is a side elevational view of modified design for a plunger and stud for use in the assembly of the invention.
Figure 7:
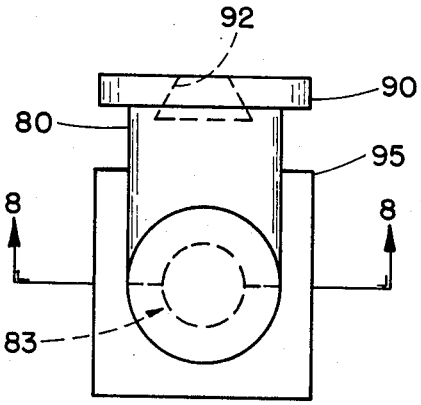
FIG. 7 is a front view of the plunger and stud of FIG. 5.
Figure 8:
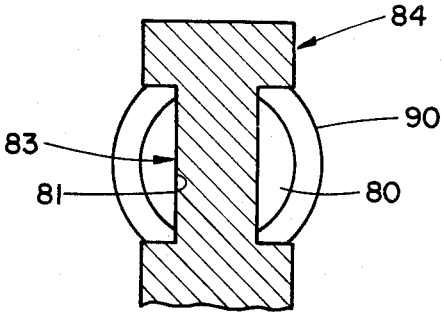
FIG. 8 is a sectional view taken along the line 8—8 of FIG. 7.

FIGS. 6–8 disclose a stud and lock plunger mating design which is compatible with the lock assembly of the invention which eliminates the extensible balls provided in lock plungers of the removable barrel locks of the prior art. In this modified structure, the solid, cylindrical plunger 80 is flanged as at 90 at its top for seating engagement within a lock housing when in the closed position and provides a key receiving socket 92. It is formed at its lower end with a semi-cylindrical cutout portion 81 for mating with the cylindrical surface 82 of an annular groove 83 in the stud 84. The radial walls 85, 86 and the cylindrical surface 82 of the groove retain the lower end of the plunger with the radial walls preventing the stud from moving axially when the stud and plunger are mated in the locked position. The stud is flanged as at 95 providing attachment means for the stud to an enclosure wall, for example, and providing limited axial movement into a stud opening in a lock housing.

This construction enables the placement of the stud upon the enclosure to be locked without the need for attention to radial accuracy, as is required when the stud provides a bore or opening or cutout portion for reception of the locked plunger.

In operation, all of the modifications of the invention disclosed permit the entry of a key (shown diagramatically and in phantom only in FIG. 1, similar in all respects to prior art keys which are utilized to remove barrel locks. The key shaft 100 is inserted through the key opening 18, 38, 58 so that the operating end, which is provided with spreading members 101 is disposed within the key socket 21, 31, 62 and 92. The key is operated in the usual manner to spread the members to engage the walls of the socket and then the key is withdrawn to pull the lock plunger from the closed position to the open position. The open position of the plunger in FIG. 4 is shown in phantom.

Many further modifications of the invention will occur to those skilled in the art within the scope of the claims appended to this specification.

I claim:

1. A key operated lock housing and lock assembly comprising a housing with intersecting lock and stud openings, means closing an end of said lock opening and providing a key opening, a lock plunger within said lock opening and spaced from said closing means and movable away from said closing means to a closed position intersecting said stud opening and toward said closing means to an open position, and means urging said lock plunger to the closed position, said lock plunger comprising a solid body and provided at its end facing said closing means with a key socket aligned with said key opening, said closing means constituting means for capturing said urging means and said lock plunger within said lock opening in said housing.

2. The key operated lock housing and lock assembly of claim 1 wherein said urging means is a compression spring and a sleeve is interposed between said lock plunger and said closing means within the coils of said compression spring and constituting means for preventing a key from contacting said compression spring.

3. The key operated lock housing and lock assembly of claim 2, wherein said sleeve extends from and is integral with said lock plunger.

4. The key operated lock housing and lock assembly of claim 1, including means permanently restraining said closing means against removal from said lock housing.

5. The key operated lock housing and lock assembly of claim 4, wherein said restraining means comprises the dimensions of said closing means and said lock opening providing a press fit of said closing means in said lock opening.

6. The key operated lock housing and lock assembly of claim 1, including an opening traversing said housing adjacent said stud opening and constituting means for receiving removable detent means for holding said lock plunger in the open position.

7. The key operated lock housing and lock assembly of claim 1, including a locking stud axially movable in said stud opening, said locking stud and said lock plunger being formed with means comprising mating surfaces for restraining axial movement of said stud when said lock plunger is in the closed position.

8. The key operated lock housing and lock assembly of claim 7, wherein said stud includes a shaft formed with an annular groove extending axially of said shaft and defined by radial walls at opposite ends of a cylindrical surface, said lock plunger being formed at its free end as a saddle to fit within the groove between said radial walls.

9. The key operated lock housing and lock assembly of claim 1, including sealing means for covering said key opening against entry of a key.

* * * * *